US011616296B2

(12) United States Patent
Yang et al.

(10) Patent No.: US 11,616,296 B2
(45) Date of Patent: Mar. 28, 2023

(54) PHASE SHIFTER ASSEMBLY HAVING RACK-DRIVEN WIPER SUPPORTS THEREIN

(71) Applicant: CommScope Technologies LLC, Hickory, NC (US)

(72) Inventors: Chongli Yang, Suzhou (CN); Guomin Ding, Suzhou (CN); WeiDong Wen, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 50 days.

(21) Appl. No.: 17/492,065

(22) Filed: Oct. 1, 2021

(65) Prior Publication Data

US 2022/0021113 A1 Jan. 20, 2022

Related U.S. Application Data

(63) Continuation of application No. 17/061,324, filed on Oct. 1, 2020, which is a continuation of application (Continued)

(30) Foreign Application Priority Data

Aug. 10, 2018 (CN) ..... 201810905275.8

(51) Int. Cl.
*H01Q 3/32* (2006.01)
*H01Q 1/24* (2006.01)

(52) U.S. Cl.
CPC ..... *H01Q 3/32* (2013.01); *H01Q 1/246* (2013.01)

(58) Field of Classification Search
CPC ..... H01Q 3/32; H01Q 1/246; H01P 1/184
See application file for complete search history.

(56) References Cited

U.S. PATENT DOCUMENTS 7,170,466 B2 1/2007 Janoschka
7,233,217 B2 * 6/2007 Phillips ..... H01P 1/184 333/116

(Continued)

FOREIGN PATENT DOCUMENTS

CN 207303304 U 5/2018
EP 3125366 A1 * 2/2017 ..... H01P 1/18

(Continued)

OTHER PUBLICATIONS

Sakib et al. "An approach to build simplified semi-autonomous Mars Rover" 2016 IEEE Region 10 Conference (TENCON) (pp. 3502-3505) (Nov. 22-25, 2016).

*Primary Examiner* — Seokjin Kim
(74) *Attorney, Agent, or Firm* — Myers Bigel, P.A.

(57) ABSTRACT

A phase shifter assembly includes first and second phase shifters that respectively include a wiper printed circuit board and a rotatable wiper support, where the wiper printed circuit board and the wiper support are coupled in motion. The phase shifter assembly further comprises: a U-shaped bracket having first and second arms, where the first phase shifter is held on the first arm, and the second phase shifter is held on the second arm; and a rack that is linearly movably supported and is drivable to move linearly; wherein the slide holders has a tooth portion respectively, and the tooth portions are engaged with the common rack. By means of linear movement of the rack, the slide holders can be rotated respectively, and thus the slides are movable within a predetermined range respectively so as to implement phase shifts.

12 Claims, 4 Drawing Sheets

Related U.S. Application Data

No. 16/527,315, filed on Jul. 31, 2019, now Pat. No. 10,833,407.

(56) References Cited

U.S. PATENT DOCUMENTS

| | | | | |
|---|---|---|---|---|
| 7,358,922 | B2 * | 4/2008 | Le | H01Q 1/246 343/810 |
| 8,674,787 | B2 | 3/2014 | Bradley et al. | |
| 11,201,402 | B1 | 12/2021 | Huangfu et al. | |
| 2002/0126059 | A1 | 9/2002 | Zimmerman et al. | |
| 2003/0048230 | A1 | 3/2003 | Heinz et al. | |
| 2006/0077098 | A1 * | 4/2006 | Zimmerman | H01Q 3/32 342/372 |
| 2007/0080886 | A1 | 4/2007 | Thomas et al. | |
| 2008/0024385 | A1 | 1/2008 | Zimmerman | |
| 2008/0297414 | A1 | 12/2008 | Krishnaswamy et al. | |
| 2010/0053008 | A1 * | 3/2010 | Le | H01Q 1/246 343/745 |
| 2010/0201590 | A1 | 8/2010 | Girard et al. | |
| 2011/0063049 | A1 | 3/2011 | Bradley et al. | |
| 2011/0267231 | A1 | 11/2011 | Le et al. | |
| 2016/0134007 | A1 * | 5/2016 | Ding | H01Q 3/26 343/880 |
| 2020/0006848 | A1 * | 1/2020 | Ding | H01Q 3/32 |
| 2020/0321697 | A1 | 10/2020 | Zimmerman et al. | |
| 2022/0006167 | A1 * | 1/2022 | P | H01Q 21/08 |

FOREIGN PATENT DOCUMENTS

| | | | | |
|---|---|---|---|---|
| EP | 3125366 | A1 | 2/2017 | |
| GB | 2384369 | A * | 7/2003 | H01P 1/184 |
| GB | 2384369 | A | 7/2003 | |
| WO | 2016137567 | A1 | 9/2016 | |
| WO | 2016173614 | A1 | 11/2016 | |
| WO | 2019074704 | A1 | 4/2019 | |

* cited by examiner

PHASE SHIFTER ASSEMBLY HAVING RACK-DRIVEN WIPER SUPPORTS THEREIN

REFERENCE TO PRIORITY APPLICATIONS

This application is a continuation of U.S. application Ser. No. 17/061,324, filed Oct. 1, 2020, which is a continuation of U.S. application Ser. No. 16/527,315, filed Jul. 31, 2019, now U.S. Pat. No. 10,833,407, which claims priority under 35 U.S.C. § 119 to Chinese Patent Application No. 201810905275.8 (Serial No. 2018081001219430), filed Aug. 10, 2018, the entire contents of which are hereby incorporated herein by reference.

FIELD OF THE INVENTION

The present invention relates to the field of communications, and more particularly to a phase shifter assembly.

BACKGROUND

There are a large number of base stations in a mobile communication system. Each base station includes one or more base station antennas. The base station antennas are typically implemented as linear or planar arrays of radiating elements, where each radiating element will be referred to as an "antenna unit" herein. With a need to cover or optimize the mobile communication network, the elevation angle of an antenna beam generated by a base station antenna should have an adjustable orientation. This may be achieved, for example, by including a phase shifter in the base station antenna which can be used to adjust the phases of the sub-components of the radio frequency (RF) signals that are transmitted or received through the array of antenna units. By changing the phase distribution of the sub-components of the RF signals that are transmitted (or received) through each antenna unit of the array antenna, the downtilt angle of the antenna beam may be adjusted.

In practice, the phase shifters are mainly divided into two types, which are referred to herein as "medium" phase shifters and as "physical" phase shifters. Medium phase shifters implement the phase shift by changing the distance along a transmission line that corresponds to a wavelength of the RF signal by changing an electrical property of the transmission line. Physical phase shifters implement the phase shift by changing a physical length of the transmission line that the RF signal traverses.

Phase shifter assemblies are known in the art in which two physical phase shifters are provided in one plane side by side with each other. Each phase shifter is implemented as a so-called "wiper arm" phase shifter that includes a main printed circuit board and a rotatable wiper printed circuit board that is mounted above or below the main printed circuit board. The wiper printed circuit boards may be mounted on respective wiper supports, and each wiper support may be pivotally mounted for rotational movement with respect to a respective main printed circuit board. Each wiper support may include a pin that is received within a respective slot of a guide member. A pull rod of a mechanical linkage may drive the guide member, and movement of the guide member in turn acts to rotate the wiper supports in order to implement the phase shift. This phase shifter assembly, however, tends to occupy a large area within the base station antenna, so that it is possible to only arrange a limited number of these phase shifter assemblies within a predetermined area. In addition, the movement stroke of the pull rod of the mechanical linkage has a non-linear relationship with the rotation angle of the wiper supports, and the transmission accuracy is low, so that the adjustment of the phase shift is correspondingly low in accuracy.

From U.S. Patent Publication No. 2008/0024385A1 and U.S. Pat. No. 8,674,787B2 respectively, there is known a phase shifter assembly, wherein two phase shifters and other fittings are held together using a large number of fasteners. This phase shifter assembly includes a large number of parts, is expensive to assemble, and has limited accuracy in adjusting the phase shift.

SUMMARY

A phase shifter assembly is provided that includes a first phase shifter and a second phase shifter. Each phase shifter may include a wiper printed circuit board that is, preferably fixedly, mounted on a rotatable wiper support. The phase shifter assembly further comprises a U-shaped bracket having a first arm, a second arm and a bottom edge connecting the first arm and the second arm, wherein the first phase shifter is mounted on the first arm, and the second phase shifter is mounted on the second arm; and a rack that is configured to move linearly.

At least one of the wiper supports is rotationally coupled to a tooth portion that engages the rack. The wiper supports are configured to rotate in response to linear movement of the rack, and wiper printed circuit boards are configured to rotate in response to rotation of the respective wiper supports within a predetermined range so as to implement respective phase shifts.

For example, a first of the wiper supports is rotationally coupled to a first tooth portion that is engaged with the rack. The second of the wiper supports may be configured to track the rotational movement of the first of the wiper supports or may be rotationally coupled to the first tooth portion or to a second tooth portion which is engaged with the rack. In response to linear movement of the rack, the wiper supports can be rotated respectively, and thus the wiper printed circuit boards are movable respectively within a predetermined range so as to implement a phase shift.

Here, by arranging the two phase shifters in two planes one above another, compared with the arrangement of the two phase shifters in the same plane, the area occupied by the phase shifter assembly may be reduced, that is, a larger number of phase shifter assemblies may be arranged in the same area. In addition, the rack transmission may have improved accuracy compared to the guide element transmission mechanism in the prior art.

In some embodiments, each wiper printed circuit board and a respective one of the wiper supports are constructed to be an integrated member; or each wiper printed circuit board and the respective one of the wiper supports are separate parts with each wiper printed circuit board mounted on the respective wiper support; or each wiper printed circuit board and the respective one of the wiper supports are separate parts and each wiper printed circuit board is coupled in motion with the respective wiper support by a transmission mechanism.

Thus, each pair of a wiper printed circuit board and a wiper support may be formed as a single integrated member. Alternatively, the wiper printed circuit boards and the respective wiper supports may be constructed as separated parts, and each wiper printed circuit board may be fixedly mounted on a respective one of the wiper supports. As a further alternative, each wiper printed circuit board and its associated wiper support may be constructed as separate parts, and the wiper printed circuit board may be coupled in motion with the wiper support by a transmission mechanism. For example, it is possible that the rotational movement of the wiper support is converted into a linear movement of the wiper printed circuit board by means of the transmission mechanism. It is particularly advantageous that, the wiper printed circuit board and the wiper support are fixed to each other and thus can be moved together.

The rotational coupling of each of the wiper supports to a tooth portion may for example be implemented as follows: the rotational movement of the tooth portion is converted into a rotational movement of the wiper support by means of a reduction transmission mechanism. It may be particularly advantageous that the single wiper support and the corresponding tooth portion be connected rotation-fixedly, and especially constructed integrally, thus minimizing the number of parts.

In some embodiments, each wiper support has a first end and a second end, where each wiper support is rotatably supported on the bracket or on the respective phase shifter at its first end, and has the tooth portion on its second end that is integrated or connected rotation-fixedly.

In some embodiments, the first and second phase shifters are arranged to overlap with each other. Accordingly, it is possible to minimize the area occupied by the phase shifter assembly, so that it is only necessary to occupy about half of the area compared to the prior art. It is also possible that, the two phase shifters are arranged to be staggered parallel to each other.

In some embodiments, the first and second phase shifters respectively include a main printed circuit board, and the wiper printed circuit board is slidable on a predetermined area of the main printed circuit board to implement the phase shift. For example, the main printed circuit board may be provided with a phase shift circuit, and the wiper printed circuit board moves relative to the main printed circuit board, so that there is a change in the length of the transmission path of the RF signal, thereby implementing the phase shift.

In some embodiments, conductor guiding portions are provided on the U-shaped bracket in such a way as to be adjacent the respective longitudinal ends of each of main printed circuit boards, wherein respective first ends of a plurality of conductors are connected to the main printed circuit boards by passing through the respective conductor guiding portions. This connection may be achieved, for example, by soldering.

In some embodiments, the U-shaped bracket is constructed as an integral component. Alternatively, the bracket may also be formed by connecting a plurality of members.

In some embodiments, the U-shaped bracket is a metal cast member or a metal sheet formed member or a plastic molded member. The assembly of other parts of the phase shifter assembly is facilitated by the U-shaped bracket.

In some embodiments, from one of the arms of the U-shaped bracket, at least one support leg projects at an angle with the one arm. Thereby, the phase shifter assembly can be easily installed in a housing. The support leg may be an integral constituent part of the U-shaped bracket, for example fabricated together during the casting or during the punch forming; and may also be a separate member and connected to the bracket, for example connected by screws, riveted or welded.

According to further embodiments, the phase shifter assembly may further comprise a shielding member that extends around the first and second phase shifters.

Pursuant to further embodiments of the present invention, a phase shifter assembly is provided that comprises a bracket having a first arm, a second arm that is spaced apart from the first arm by a gap and a bottom edge connecting the first arm and the second arm, a first phase shifter that includes a first main printed circuit board and a first wiper printed circuit board that is mounted for rotation with respect to the first main printed circuit board, the first phase shifter mounted on the first arm of the bracket, a second phase shifter that includes a second main printed circuit board and a second wiper printed circuit board that is mounted for rotation with respect to the second main printed circuit board, the second phase shifter mounted on the second arm of the bracket, and a rack that is configured to move linearly. The rack includes at least one first toothed portion and at least one of the first and second phase shifters includes a second toothed portion that engages the first toothed portion, so that the first and second wiper printed circuit boards are configured to rotate in response to linear motion of the rack in order to implement respective phase shifts.

In some embodiments, the first phase shifter further comprises a first clip that biases the first wiper printed circuit board against the first main printed circuit board, wherein a first portion of the first clip is on a first side of the first arm and a second portion of the first clip is on a second side of the first arm that is opposite the first side.

In some embodiments, the first arm is parallel to the second arm.

In some embodiments, the first phase shifter is mounted on an upper surface of the first arm and the second phase shifter is mounted on a lower surface of the second arm.

In some embodiments, the first phase shifter further comprises a first wiper support that has a first end and a second end, wherein the first end of the first wiper support is pivotally mounted above the first main printed circuit board and the second toothed portion is part of the second end of the first wiper support.

In some embodiments, the bracket is a monolithic bracket.

In some embodiments, the bracket includes a first support leg that projects at an angle from a side of the second arm.

In some embodiments, the support leg includes a lip that projects at an angle from a distal end of the support leg.

In some embodiments, the bracket comprises a U-shaped bracket.

DETAILED DESCRIPTION

Figure 1:
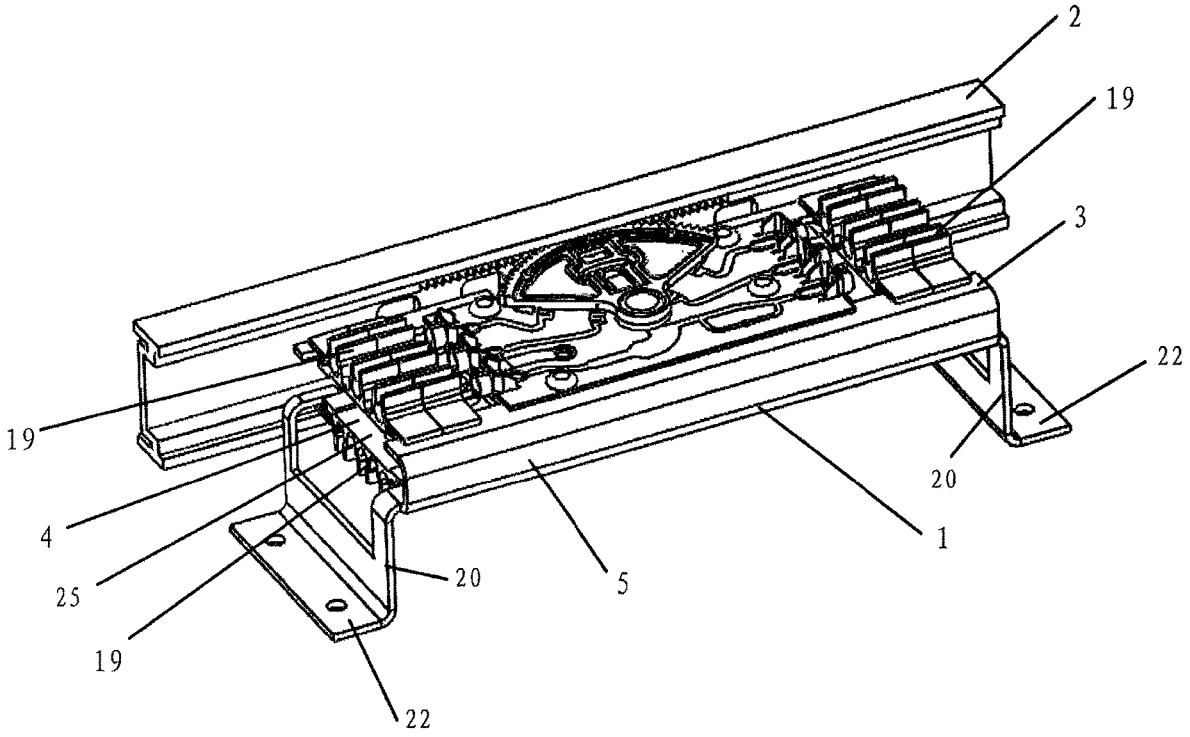
FIG. 1 is a perspective view of a phase shifter assembly in an assembled state in accordance with one embodiment of the present invention.
Figure 2:
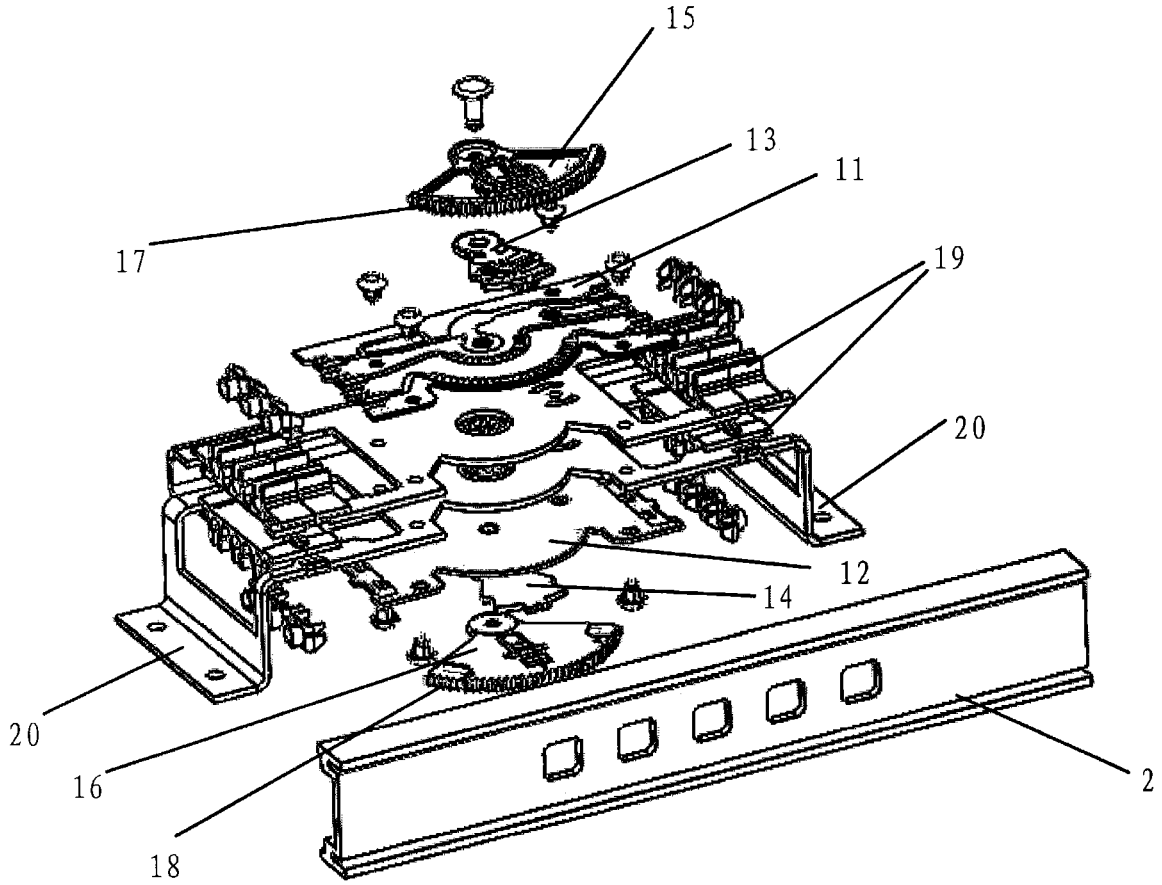
FIG. 2 is an exploded view of the phase shifter assembly shown in FIG. 1.
Figure 3:
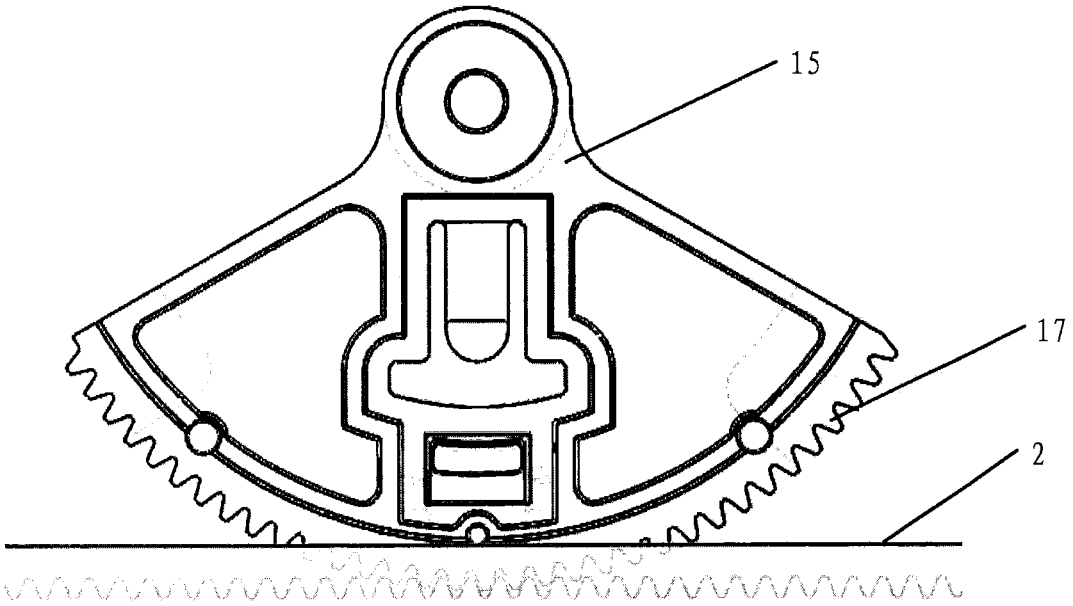
FIG. 3 is a detailed view of the wiper support of the phase shifter assembly shown in FIGS. 1 and 2.

FIG. 1 is a perspective view of a phase shifter assembly in an assembled state in accordance with one embodiment of the present invention; FIG. 2 is an exploded view of the phase shifter assembly shown in FIG. 1; and FIG. 3 is a detailed view of the wiper support of the phase shifter assembly shown in FIGS. 1 and 2.

The phase shifter assembly according to the embodiments of FIGS. 1 and 2 comprises a U-shaped bracket 1 having a first arm 3, a second arm 4 and a bottom edge 5 connecting the first arm 3 and the second arm 4. The U-shaped bracket 1 may be constructed in one piece, or may also consist of a plurality of parts. The first and second arms 3, 4 may have the same length or may have different lengths. Here, the bracket 1 is, for example an integral sheet of metal formed member by punching and/or bending.

The first phase shifter 11 is disposed on the first arm 3 of the bracket 1, and the second phase shifter 12 is disposed on the second arm 4 of the bracket 1. The first and second phase shifters are arranged to overlap with each other. The first and second phase shifters respectively include a main printed circuit board fastened to the bracket 1 by screws, wiper supports 15, 16 rotatably supported on the respective main printed circuit boards, and wiper printed circuit boards 13, 14 that are fixedly mounted on the respective wiper supports 15, 16. The wiper supports 15, 16 respectively include tooth portions 17, 18. The wiper printed circuit boards 13, 14 abut against predetermined areas of the respective main printed circuit boards.

The rack 2 of the phase shifter assembly may also be seen in FIGS. 1 and 2. The rack 2 has a front surface that faces the bracket 1 and a back surface that is opposite the front surface. The rack 2 has guiding grooves on its back surface for guiding the rack 2 in a linearly movable manner. The rack 2 has one or more tooth portions on its front surface which may correspond to the tooth portions 17, 18 of the wiper supports 15, 16. When the phase shifter assembly is assembled, the tooth portions 17, 18 of the wiper supports may be engaged with the tooth portions of the rack 2. The rack 2 can be driven to move linearly. For example, the rack 2 may be driven linearly by a stepper motor. The rack 2 may be supported, for example, on a separate rack holder (not shown), and the rack holder may be fixed to a housing of the base station antenna. As an alternative, the rack 2 may also be supported directly on the housing, or the housing itself may include the rack holder.

When the rack 2 is driven, for example, by a stepper motor, the rack 2 moves linearly, and the wiper supports 15, 16 are driven to rotate, so that the wiper printed circuit boards 13, 14 rotate with respect to the respective main printed circuit boards, thereby implementing the phase shifts.

In the embodiments shown in FIGS. 1 and 2, the two wiper supports 15, 16 are respectively supported so as to enable rotational movements that are independent of each other, and a joint rotational movement by engagement with the common rack 2. Alternatively, the two wiper supports 15, 16 may be connected so as to be fixed to each other with respect to rotational movement, and only one of the wiper supports 15, 16 has a tooth portion which is engaged with the rack 2. In such an embodiment, when the rack 2 moves linearly, a first of the wiper supports 15, 16 rotates, and the second of the wiper supports 15, 16 is forced to rotate in tandem with the first of the wiper supports 15, 16. In addition, it is also possible that, the tooth portion is disposed on a common rotary shaft of the two wiper supports 15, 16, for example centrally disposed between the two wiper supports 15, 16. It is self-evident that, more tooth portions may be additionally provided in order to achieve a better force transfer from the rack 2 to each of the wiper supports 15, 16. Such modification also falls within the protection scope of the present invention.

In the embodiments shown, the two wiper supports 15, 16 are each provided with an integral tooth portion, and thus each wiper support 15, 16 and the respective tooth portion are rotation-fixed. It is also possible that each tooth portion is constructed as a separate member that is connected to the respective wiper support 15, 16 so that rotation of a tooth portion results in a corresponding rotation of the respective wiper support 15, 16.

The bracket 1 includes a plurality of sets of conductor guiding portions 19. For example, a set of conductor guiding portions 19 may be provided at each side of each of the main printed circuit boards (for a total of four sets of conductor guiding portions 19). Each conductor guiding portion 19 may be implemented, for example, as a clip or other structure that receives a respective conductor. A plurality of conductors (not shown) such as, for example, coaxial cables, may be soldered to each main printed circuit board, and each conductor guiding portion 19 may receive a respective one of these coaxial cables. A support leg 20 projects substantially in a perpendicular manner, respectively at both ends of the second arm 4 of the bracket 1 in a longitudinal direction. Each support leg 20 includes a lip 22 that is provided with screw holes, for fastening the bracket 1 to the housing (not shown) by screws.

As can best be seen in FIG. 1, the first and second arms 3,4 of the U-shaped bracket are separated by a gap 25. Many wiper arm phase shifters include a clip that is used to bias the wiper printed circuit board to press against the main printed circuit board. This may facilitate providing consistent coupling of sub-components of an RF signal between the wiper printed circuit board and the main printed circuit board of the wiper arm phase shifter. One side of the clip typically engages the wiper support or the wiper printed circuit board, while the other side of the clip engages main printed circuit board or a support plate (e.g., a piece of sheet metal) on which the main printed circuit board may be mounted.

If two wiper arm printed circuit boards are mounted on opposite sides of a support plate, it may be difficult to use the above-described support clips. For example, if a support clip is added to the phase shifter mounted on an upper surface of the support plate, the bottom portion of the clip will need to extend below the support plate. However, in this position, the support clip may interfere with operation of the phase shifter that is mounted on the lower surface of the support plate.

By providing the U-shaped bracket 1 having first and second arms 3, 4 that are separated by a gap 25, it is possible to mount the phase shifters on two different arms, each of which serves as a respective support plate. Accordingly, a clip may be used with each phase shifter to bias the wiper printed circuit board to press against the main printed circuit board, since the clip for a first phase shifter will not get in the way of operation of the second phase shifter. The gap 25 also spaces the sets of conductor guiding portions 19 for the first phase shifter from the sets of conductor guiding portions 19 for the second phase shifter.

As can best be seen in FIG. 2, the first phase shifter may face in a first direction (e.g., upwardly) while the second phase shifter may face in the opposite direction (e.g., downwardly). This may simplify assembly of the phase shifter assembly, particularly in embodiments in which the U-shaped bracket 1 is a single-piece (monolithic) bracket.

Figure 4:
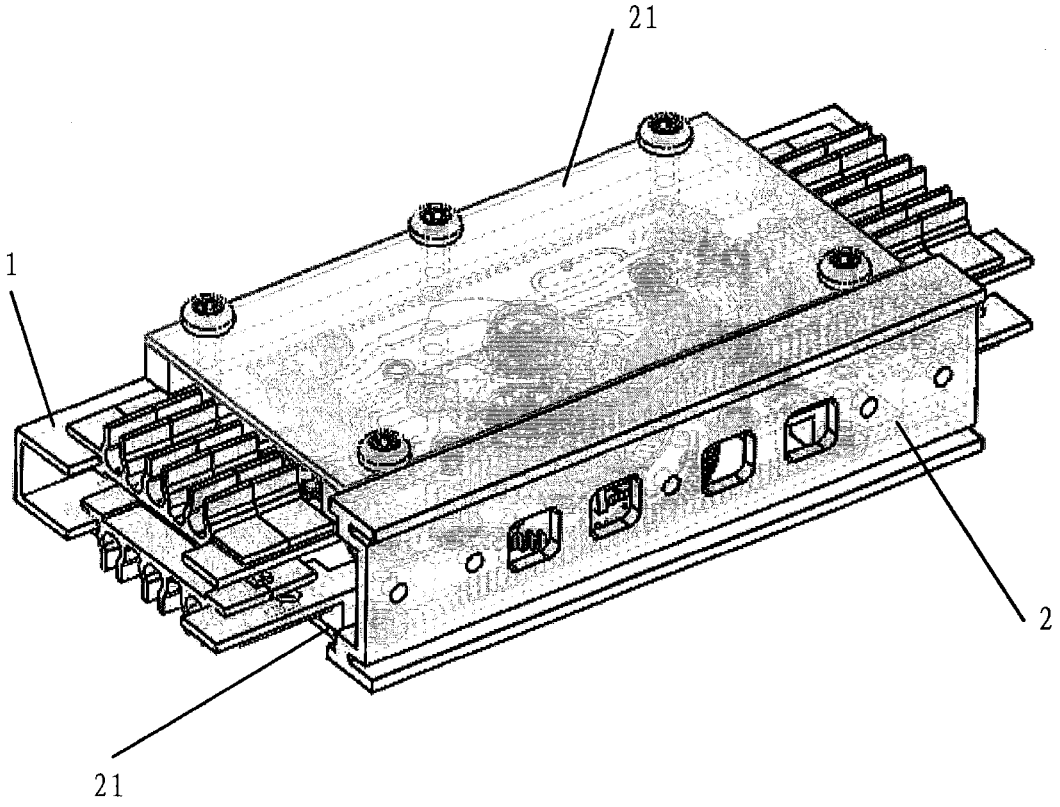
FIG. 4 is a schematic view of a phase shifter assembly with a shielding member in accordance with one embodiment of the present invention.

FIG. 4 shows a schematic view of a phase shifter assembly with a shielding member 21 in accordance with a further embodiment of the present invention. In addition to the shielding member 21, other members of the phase shifter assembly may be constructed identically or similarly to the embodiments shown in FIGS. 1 and 2. The shielding member 21 is fastened by screws outside the two phase shifters.

Finally, it is to be noted that, the above-described embodiments are merely for understanding the present invention but do not constitute a limit on the protection scope of the present invention. For those skilled in the art, changes may be made on the basis of the above-described embodiments, and these changes do not depart from the protection scope of the present invention. The technical features recited in the present application can be arbitrarily combined as long as such combinations are not contradictory to each other, and all of these combinations are the technical contents recited in the present application.

That which is claimed is:

1. A phase shifter assembly, comprising:

an arm and a first support leg extending at an angle from a first side of the arm;

a phase shifter including a main printed circuit board and a wiper support rotatably supported on the main printed circuit board, on the arm;

a first set of conductor guiding portions adjacent a first side of the main printed circuit board such that first conductors received by the first set of conductor guiding portions and soldered to the first side of the main printed circuit board pass into an opening in the first support leg;

a second support leg extending at an angle from a second side of the arm;

a second set of conductor guiding portions adjacent a second side of the main printed circuit board such that second conductors received by the second set of conductor guiding portions and soldered to the second side of the main printed circuit board pass into an opening in the second support leg;

wherein the first support leg includes a first lip at a distal end thereof;

wherein the second support leg includes a second lip at a distal end thereof;

wherein the first and second lips have fastening screw holes therein; and wherein the arm, and the first and second support legs, including the first and second lips, are formed from an integral sheet of metal by punching and/or bending.

2. A phase shifter assembly, comprising:

an arm and a first support leg extending at an angle from a first side of the arm;

a phase shifter including a main printed circuit board and a wiper support rotatably supported on the main printed circuit board, on the arm;

a first set of conductor guiding portions adjacent a first side of the main printed circuit board such that first conductors received by the first set of conductor guiding portions and soldered to the first side of the main printed circuit board pass into an opening in the first support leg; and a rack having tooth portions engaged with tooth portions of the wiper support.

3. The phase shifter assembly according to claim 2, wherein the first set of conductor guiding portions are sufficiently aligned with a first side of the main printed circuit board that first conductors received by the first set of conductor guiding portions and soldered to the first side of the main printed circuit board pass through an opening in the first support leg; and wherein the wiper support has a wiper printed circuit board fixedly mounted thereon.

4. A phase shifter assembly, comprising:

a multi-part bracket including an arm, a first support leg, having a first opening therein, extending at an angle from a first side of the arm, and a second support leg, having a second opening therein, extending at an angle from a second side of the arm;

a phase shifter including a main printed circuit board and a wiper support rotatably supported on the main printed circuit board, on the arm; and first and second sets of conductor guiding portions extending adjacent the first and second openings in the first and second support legs, respectively;

wherein the first support leg includes a first lip at a distal end thereof; wherein the second support leg includes a second lip at a distal end thereof; and wherein the first and second lips have fastening screw holes therein; and wherein the arm, and the first and second support legs, including the first and second lips, are formed from an integral sheet of metal by punching and/or bending.

5. A phase shifter assembly, comprising:

a multi-part bracket including an arm, a first support leg, having a first opening therein, extending at an angle from a first side of the arm, and a second support leg, having a second opening therein, extending at an angle from a second side of the arm;

a phase shifter including a main printed circuit board and a wiper support rotatably supported on the main printed circuit board, on the arm;

first and second sets of conductor guiding portions extending adjacent the first and second openings in the first and second support legs, respectively; and a rack having tooth portions engaged with tooth portions of the wiper support.

6. The phase shifter assembly according to claim 5, wherein the first and second sets of conductor guiding portions are aligned to the first and second openings in the first and second support legs, respectively; and wherein each of the conductor guiding portions within the first and second sets of conductive guiding portions is configured to receive a respective conductor therein.

7. A phase shifter assembly, comprising:

a multi-part bracket including a first arm and a second arm;

a first phase shifter including a first main printed circuit board and a first wiper support rotatably supported on the first main printed circuit board, on the first arm;

a second phase shifter including a second main printed circuit board and a second wiper support rotatably supported on the second main printed circuit board, on the second arm; and a rack having tooth portions engaged with first tooth portion of the first wiper support and second tooth portion of the second wiper support;

wherein at least one of the first arm and the second arm includes a pair of support legs having lips on distal ends thereof; and wherein the pair of support legs includes a first support leg having a first opening therein and a second support leg having a second opening therein.

8. The phase shifter assembly of claim 7, wherein the first wiper support has a first wiper printed circuit board fixedly mounted thereon.

9. The phase shifter assembly according to claim 7, wherein the first tooth portion extends adjacent a distal end of the first wiper support; and wherein the second tooth portion extends adjacent a distal end of the second wiper support.

10. The phase shifter assembly according to claim 7, wherein linear movement of the rack causes rotational movement of the first wiper support and the second wiper support.

11. The phase shifter assembly according to claim 7, further comprising a first set of conductor guiding portions extending adjacent the first opening, and a second set of conductor guiding portions extending adjacent the second opening.

12. A phase shifter assembly, comprising:

a multi-part bracket including a first arm and a second arm;

a first phase shifter including a first main printed circuit board and a first wiper support rotatably supported on the first main printed circuit board, on the first arm;

a second phase shifter including a second main printed circuit board and a second wiper support rotatably supported on the second main printed circuit board, on the second arm; and a rack having tooth portions engaged with first tooth portion of the first wiper support and second tooth portion of the second wiper support;

wherein the first arm is stacked vertically relative to the second arm; and wherein the first phase shifter and the second phase shifter overlap with each other.

* * * * *